US006082365A

United States Patent [19]

Yenin

[11] Patent Number: 6,082,365

[45] Date of Patent: Jul. 4, 2000

[54] ANTI-SCOLIOSIS BIO-MECHANICAL VIBRATION-DECOMPRESSION COMPRESSION GYMNASTICAL HEALTH-IMPROVING METHOD (ASKOVIBRO-METHOD) IN A COMPLETE CONSERVATIVE TREATMENT OF SCOLIOSIS OF THE SPINE

[76] Inventor: Vladimir Petrovich Yenin, A/R 9869, Krasnoyarsk, Russian Federation, 660077

[21] Appl. No.: 09/076,120

[22] Filed: May 12, 1998

[30] Foreign Application Priority Data

May 12, 1997 [RU] Russian Federation ..... 2104684

[51] Int. Cl.[7] ..... A61R 19/00

[52] U.S. Cl. ..... 128/898; 601/23; 601/46

[58] Field of Search ..... 128/898; 601/2, 601/23, 46, 84; 482/23, 148

[56] References Cited

U.S. PATENT DOCUMENTS

| | | | |
|---|---|---|---|
| 4,949,712 | 8/1990 | Torii | 128/28 |
| 5,462,518 | 10/1995 | Hatley et al. | 602/36 |
| 5,785,667 | 7/1998 | Foner | 601/23 |

FOREIGN PATENT DOCUMENTS

1747068 A1 7/1992 U.S.S.R. .

OTHER PUBLICATIONS

TIPCO VIBROTRACKS, Equipment Brochure, pp. 1–9, together with English translation of relevant portions of the Brochure.

*Primary Examiner*—Dinh X. Nguyen
*Attorney, Agent, or Firm*—Sughrue, Mion, Zinn Macpeak & Seas, PLLC

[57] ABSTRACT

A method for the treatment of scoliosis of the spine. Vibro-influence is performed on the spine with a frequency of 10–50 Hz, and an amplitude 1–5 mm. Simultaneously the muscles are alternately placed in tension and relaxation for 5–10 second intervals. A vibro-influence is performed without decompression of the spine and on the background of horizontal with an effort of 10–40 kg and alternating with a vertical one, repeating them during the treating session. The duration of the treatment session is 2–3 hours. The course of treatment is 15–20 sessions during one month, with possible repetition in 3, 6, 9 months. Vibro-influence is combined with manual therapy, medical massage, electric stimulation, thermal magnetic therapy, X-ray therapy, diet therapy, psycho-therapy and medical correction of the life style. The method provides for the restoration of full value of supportive and locomotory function of the spine.

25 Claims, No Drawings

ANTI-SCOLIOSIS BIO-MECHANICAL VIBRATION-DECOMPRESSION COMPRESSION GYMNASTICAL HEALTH-IMPROVING METHOD (ASKOVIBRO-METHOD) IN A COMPLETE CONSERVATIVE TREATMENT OF SCOLIOSIS OF THE SPINE

1. BACKGROUND OF THE INVENTION

Today scoliosis of the spine is the most topical part of orthopedy, despite the multi-century practice of treatment.

The analysis of the specialized literature, saturated with a great number of theories (the hormonal, vascular, involutional, anomalous, functional, hereditary, etc.), which explain the development of scoliosis, confirms the multi-factor ethiopatho-genesis of scoliosis rather than the truth of one theory.

The variety of conservative and operative methods of treating scoliosis correspond to the variety of the ethiopatho-genetic theories, which indicate again the insufficient effectiveness of various methods, methodologies, and medicines for counteracting the disease (Kazamin A. I. et al. "Scoliosis," M.:Medicine, 1981).

During the last decade there have been a variety of widely used methods (both preventive and curative) utilizing vibrational influences on the muscles of the human body for both treating and treatment. These methods can be viewed as related to the present invention. Methods that combine vibrational and decompressional influence on spinal disease are also known.

The closest analogue (prototype) of the invention is the method and treatment and prevention of the spine curvature, which is performed through a device for vibro-relaxation of the muscles and vibro-stretching of the spine as set forth in SU 1747068 to Kiev Engineering & Construction Institute, 1990, and incorporated herein by reference.

However, all the above mentioned sources of information do not describe the essence of the sano-genetic approach to the treatment of scoliosis. The results of the treatment of patients, who suffer from scoliosis, are not always successful in either the domestic or foreign orthopedics. The treatment of progressing scoliosis, especially in an untreated, destructive stage, presents the greatest difficulty for specialists and the patients themselves. Because of the severe muscular-tonic, vegative-vascular and neuro-dystrophy complications, scoliosis brings a lot of disappointments to the patient and the treating doctor.

The scoliosis curvature of the spine is viewed by the present invention as the compensational or decompensational adapto-genic biomechanical reaction, which balances the axial support load on the spine and is classified into two groups;

1. Functional—with a compensated form of curvature, which is adequate to the physical load, after which the muscles and the joint-ligamental organs keep the ability to reestablish the symmetrical balance of the spine on the vertical axis in sagittal dimension.

2. Pathological—with steady curvatures of the spines, which are not corrected by the muscle corset and are viewed as a spinal-locomotory defect at scoliosis.

Reformation of the curvatures of the spine of the first group into the second one, pathological is observed more often during the period of intensive growth of the height of the body (until the age of 15), when a heightened vulnerability of the growing zones in the spinal locomotory segments (SLS) at a chronic asymmetry of the compressional load on the joints of the spine and intervertebral discs can be noted. At adynamia and asymmetry of static and dynamic traumatic overload (during incorrect posture) the functional load on the joints and intervertebral discs changes, and the asymmetrical muscular corset develops. Gradually, the asymmetrically tensed muscles lose the ability to restore the balance, and maintain and provoke a steady development of scoliosis. This is often noted as progressing scoliosis regardless of the strength of the muscular corset. Dissimilarities are characteristic of curvatures of the spine. The multitude of forms of scoliosis is determined by; (a) the cause, degree, and stage of development of the pathological process, (b) the localization and the clinical picture of the complex mechanism of inclusion into the pathological destructive process of the tissue of intervertebral articulations and muscles, which provide the movement of the spine in three dimensions.

The complex combination of the bio-mechanical changes in the spine during decompensation and blockage in some of its parts, and the corresponding hyper-mobility at static-dynamic hyper-load in others is illustrated with ostheochondric and pathetic complications, disc-radicular conflicts, and manifestations of reflexogenic aching condition, which are manifested by aching irradiation at radicular ischemia.

During deprivation of movement and violation of biomechanics in the spinal-locomotory segments (SLS), the micro-circulation and metabolism are violated, calcination of cartilage and decalcination of the bone tissue progresses, and the dystrophy of muscles appears in the state of their spastic reflex over-tension. The articulations of the spine and the intervertebral discs deform, joining plate sclerotise with ostheo-phyts.

As a result, the metabolic osteochondro-pathic changes, and the myoneuro-dystrophy proceeds with a static-dynamic violation of the biomechanics of the spine and the pathological reflex lock into a vicious circle of a progressing scoliosis.

DETAILED DESCRIPTION OF THE INVENTION

The present invention has set the health improving purpose—to break this pathological circle of the scoliosis progression by initially developing the proper biomechanical position, sanology and sano-genesis for reestablishing the full value of supportive and locomotory function of the spine with scoliosis into a normal-stenic state of symmetrical balance.

In order to remove the pathological functional factors and organic destructive components in the development of scoliosis, the present invention comprises an original combination of health improving anti-scoliosis measures. The invention is a method for the treatment of scoliosis of the spine. Vibro-influence is performed on the spine with a frequency of 10–50 Hz, and an amplitude 1–5 mm. Simultaneously the muscles are alternately placed in tension and relaxation for 5–10 second intervals. A vibro-influence is performed without decompression of the spine and on the background of horizontal with an effort of 10–40 kg and alternating with a vertical one, repeating them during the treating session. The duration of the treatment session is 2–3 hours. The course of treatment is 15–20 sessions during one month, with possible repetition in 3, 6, 9 months. Vibro-influence is combined with health improving anti-scoliosis measures including: manual therapy, medical massage, electric stimulation, thermal magnetic therapy, X-ray therapy, diet therapy, psycho-therapy and medical correction of the life style. The method provides for the restoration of full value of supportive and locomotory function of the spine.

The corner stone of the process is the "ASKO-vibro-method", a biomechanical vibrational-decompressing gymnastic method of influence, elaborated by the author and is an object of the invention. It is used in all cases in combination with the other components—according to the evidence.

Manual therapy in the complex used is not different from the classical conception. It is a combination of methods of macro-correction with the use of long and short levers, obligatory taking into account the character of the scoliosis location. According to the evidence, the actions may be performed including distraction, rotation, bending in sagittal and frontal dimensions, contact manipulations (taking into account the biomechanical and reflex mechanism of influence).

Rays, tomographic, and clinical data in the objective status of the patient are combined with biomechanical factors, which lie in the basis of scoliosis deformities.

After analyzing the biomechanical characteristics, the factual and the proper degrees of freedom of SLS are compared in three dimensions and six directions. At a structural analysis, the level and quantity of the blocked and hyper-mobile SLS are determined. At a kinematics analysis, the level of limitation and compensation of the trajectory of movements in SLS are determined. The dynamic analysis allows one to distinguish the character of the applications and interaction of the muscular strength into a general picture of coordination and regulation of movements in the spine.

The timely and correct diagnosis of the peculiarities of a three-dimensional curvature of the spine allows one to determine the individual volume and dosage of the correcting biomechanical rehabilitation loads.

Absolute contra-indications of the "ASKO-vibro-method" are: i.e,

1. Oncology diseases;
2. Unspecified and inflectional pathology of the spine (tuberculosis spondylitis, osteomelit in an active phase, hormonal and senile spondilopathy;
3. Pathological condition after the operational intervention in the spinal cord and brain, vessels;
4. Disease of internal organs of cardiovascular and nervous system, psyche in a condition of decompression;
5. Osteoporosis of spine of different ethology;
6. Excessive mobility of the spinal segment with progressing manifestation of myo-neurodystrophy;
7. Innate anomalies of the spine with pathological manifestations of decompensation;
8. Acute and underacute inflammatory diseases of the spinal cord and brain, its membranes, myelo diseases;
9. Weakly consolidated and non-consolidated fractures of spinal bones;
10. The condition after mathello-osteo-plastic surgeries on spine;
11. Ulcer disease of the digestive tube, gall-stone and kidney-stone disease in a stage of acutization;
12. Weakened nutrition with a weight deficit more than 15%.

Relative contra-indications, i.e. indicating that the Asko-Vibro method can be performed but the doctor should be extra attentive and cautious with the patient:

1. Osteo-chondropathy of $3^{rd}$–$4^{th}$ stage and a pronounced vertebro-genic syndrome of osteochondrosis of spine during the period of acutization;
2. Consolidated fracture, innate anomalies of spine and traumatic injuries of intervertebral discs without clinical manifestations;
3. Somatic and psychic diseases in a remission stage;
4. Protrusion of the intervertebral disc;
5. Decreased nutrition, hypo-myo-trophy with a weight deficit of less than 15%

The method is an integral program of an individualized system of a functional rehabilitation of the patient during the 2–3 hour long daily session, which is repeated 15–20 times during the month.

The "ASKO-vibro-method" represents a new use of the vibro-trainer, which is known as the biomechanical trainer-stimulator or BM-stimulator (manufacturer: SPA Granat, Minsk. Instructions for operation A).

The BM-stimulator is intended by the manufacturer for the physical and health-improving purposes: to perfect the physical fitness, development of flexibility, strength, improvement of the tone of the leg muscles, and was modified by the author for operation in a regime of vibrations with a frequency from 10 to 50 Hz and an amplitude from 1 to 5 mm.

The author introduced into the purposeful practice of gymnastics treatment, the device "Vibro-rings". Vibro-rings are gymnastic rings to which the vibrations of the BM-trainer are applied. The "ASKO-vibro-method" also includes the use of the vibrational stretching of the spine. For this purpose, the device "Vibrotracs" is used (as explained in a following section).

"ASKO-vibro-methods" is the main link in the chain of anti-scoliosis procedure, which adjusts the muscular corset and its ability to hold the joints of the spine in a correct posture. The dynamic, isometric, physical exercise of the anti-scoliosis decompressional vibro-gymnastics introduces a comfortable swinging regime into all the tissues in the spinal-locomotory segments. The mechanical impulses of the training low-frequency vibration transform themselves into longitudinal and latitudinal bio-stimulating loads to the spine tissues. Conditions of the combination of the alternation of the vibro-decompression with isothermal gymnastics in the "ASKO-vibro-method" effectively contribute to the creation of a strong muscular corset.

The curing and health improving factors of the anti-scoliosis decompressional vibro-therapeutic gymnastics without axial load on the spine, provoke local sano-genetic reaction in the changed spine with scoliosis. This results in differentially improved joint-muscular groups, which contribute to the processes of removing or significant diminishing the dependence on the initial pronounced scoliosis deformation of the thorax and pelvic ring, and the attained result is consolidated into a steady stereotype of a correct posture.

The "ASKO-vibro-method" allows normalization of the adaptational and trophic functions of the body. The method is particularly significant in the effective treatment the disease's gemo-dynamic, liquor-drenage functions during compressional syndrome and osteochondro-pathic manifestations.

As a result of the antiscoliosis vibro-procedures, the microcirculation of blood in SLS is improved, the compressional venous stagnation is removed, the mechanics of hydro-rotations and rehydro-rotations of the tissues are stimulated, and the muscular-tonic vibrational reflex from the receptors (Pacini bodies) normalizes. All of which provide the transmission of the vibro-perceptibility and normalize the adequate muscular reactions of a correct posture.

The bio-mechanic stimulation factors of the "ASKO-vibro-method" gradually remove the asymmetrical deforming compression on the intervertebral discs and joints of the spine which are the primary cause of the progressing dystrophy in SLS at scoliosis. During the motivation vibro-decompression of the spine with active gymnastics, the stagnant phenomena and spastic condition of muscles are excluded. As a result, the regenerating metabolic factors associated with scoliosis hemo-circulation in the capillaries of SLS, tissues of the spine are comfortably stimulated. The "ASKO-vibro-method" is performed by the following alternating procedures during the 2–3 hour session.

The patient alternates the active isometric tension of the body and limbs muscles with their volitional relaxation in horizontal position lying on the back, as well as standing and propping with the abdomen on the vibrothod of the trainer, at which the vibrations with the amplitude of 1–5 mm and the frequency of 10–40 Hz is applied. The duration of each procedure is 1–5 min, and analogous procedures are repeated 10–15 times during the session. The indicated applications are performed (in essence) in the absence of the spine decompression.

Analogous isometric gymnastics (alteration of tensing and relaxing the muscles) are performed on the background of a dosed decompression (stretching) of the spine in a lying on the back position horizontally and with a curve shaped support. The load along the spine axis is from 10–40 kg, the vibration frequency is 50 Hz, amplitude of 3–5 mm, and duration of the procedure is 3–15 min up to 3 times during one session.

The gravitational decompression of the spine is performed on the device "Vibro-rings". In this process the patient alternately hangs on rings for 5–10 seconds with relaxed muscles, in front of a mirror. The muscles are then tensed to create and keep a symmetrical auto-balance in a standing position. The exercise is performed for 1–5 minutes and is repeated 1–5 times during the session. The frequency of the vibrations in the rings is 10–20 Hz, amplitude is 1–5

The synchronic and autoceptive self-checking forms the muscular corset during the treatment course, which is necessary for the static and dynamic unconditional reflex of a correct posture. The program of rehabilitation with the "ASKO-vibro-method" can be repeated after 3, 6, and 9 months until scoliosis is cured in the initial functional and destructive stage of its development.

Test Results

After the completion of the rehabilitation program for treatment of scoliosis with "ASKO-vibro-method", 189 out of 203 patients noted steady positive dynamics after observation from 3 months to 3 years. This included: of 160 patients with scoliosis in its initial stage of development displaying symptoms of the pathologic posture, in which the scoliosis spine lacks manifestations of structural degenerative process, characteristics for osteochondrosis (beginning of the formation of the costal deformation —a humpback, with the deformation of the pelvic bones (twisted pelvis), with the functional hyper-mobility and the blocking of the spinal-locomotory segments, and with an inability of the muscular corset to reestablish symmetrical balance of the spine and the pelvic ring). In 131 cases (81.9%) there was no violation of the posture, the previous skeletal asymmetry and costal-joint deformation of the spine and pelvis was absent. All the 131 patients after the "ASKO-vibro method" continued systematic sessions in the regime of athletic gymnastics without axial load to the spine. The evaluation of the results was "excellent", i.e., cured: for 17 patients (10.5%) a reverse development of the scoliosis manifestation was noted with the increase from the angle of deformity of the spine with scoliosis, the height of the intervertebral discs and a growth of 0.5 to 2 cm. The muscular asymmetry of the waist was present. The unconditional reflex to the correct stereotype of the posture was absent. All 17 patients of the "ASKO-vibro-method" continued to exercise in the regime of athletic gymnastics but episodically. The evaluation results—"good", reverse development of scoliosis; for 2 patients (1.35) were noted with the stabilization of the spine with scoliosis. In 6 months after the realization of the "ASKO-vibro-method" program the growth and angle of the spine deformity did not decrease. The conditional reflexes for a correct stereotype of posture has been preserved. Both patients had infectious diseases and did not continue the athletic gymnastics. The evaluation—"satisfactory", i.e., stabilization; for 10 (6.3%) out of 160 patients the dynamic observation was not possible to perform.

Out of 43 patients with scoliosis in a stage of organ destructive (structural) manifestation with chondropathy, dystrophy in the spinal-locomotory segments of the spine with scoliosis, a rough costal and pelvic deformation, and with a progressing intervertebral discopathy and vertebrogenic affection of the nervous system after the completion of the program of conservative treatment with "ASKO-vibro-method", for 7 patients (16.2%) the visual and palpation scoliosis macro-deformation of the spine and skeletal asymmetry could not be determined. The steady unconditional reflex of the correct posture was preserved. The previous picture of vertebro-genic manifestations of the chronic asymmetrical compression ins SLS vanished. All 7 patients continued to exercise in the regimen of athletic gymnastics without axial static and dynamic loads. The evaluation—"excellent"; for 26 patients (60.55) the reverse development of the spine deformity, with a removed functional deformity of the pelvis, with a considerable decrease of the size of the costal humpback to visually hard to notice cosmetic defect with a steady unconditional reflex of the stereotype of a correct posture. Evaluation "good"; for 6 patients (13.9%) with the stabilization of the progressing process of scoliosis without the previous discogenic, radiculi and pathological reflex manifestations was observed. Evaluation—"satisfactory", stabilization of scoliosis processes; (9.3%) of the patients from 43 were not observed in the dynamics.

Besides the positive dynamics in the clinical picture without complaints of discomfort, heightened fatigability and ache of spine, with decrease or liquidation of the scoliosis deformity of the spine, and with the increase of the height of the intervertebral discs in all the cases of the practice of "ASKO-vibro-method" the rise and a steady preservation of the height form 0.5 to 4 cm was observed. There was reestablished the lost joint mobility and flexibility with qualitatively new total sanogenic biomechanical effect, which mobilizes the hidden reserve abilities of the body.

What is claimed is:

1. A method of treatment of scoliosis of the spine of a patient, comprising a treatment session which includes the following basic steps:

a) performing low frequency vibro-influence on the spine, in combination with having the patient perform isometric physical gymnastics, without spinal decompression;

b) performing low frequency vibro-influence on the spine, in combination with horizontal spinal decompression and having the patient perform isometric physical gymnastics, wherein said horizontal spinal decompression is performed by stretching; and c) performing low frequency vibro-influence on the spine, in combination with vertical spinal decompression, and having the patient perform isometric physical gymnastics.

2. The method as claimed in claim 1, wherein step (a) includes having the patient perform said isometric physical gymnastics while lying in a supine position.

3. The method as claimed in claim 2, wherein step (a) further includes performing said vibro-influence on the abdomen of the patient while the patient is in a standing position.

4. The method as claimed in claim 1, wherein said horizontal spinal decompression of step (b) is performed with the patient lying supine on a curved support.

5. The method as claimed in claim 1, wherein said isometric physical gymnastics of step (c) include alternate steps of relaxation during vibro-influence, and tension while standing in the absence of vibro-influence.

6. The method as claimed in claim 5, wherein said vibro-influence of step (c) is performed by vibrating rings from which the patient hangs.

7. The method as claimed in claim 1, wherein said vibro-influence of step (c) is performed by vibrating rings from which the patient hangs.

8. The method as claimed in claim 1, wherein step (a) includes having the patient perform isometric physical gymnastics, without spinal decompression with the spine of the patient in a horizontal position.

9. The method as claimed in claim 1, wherein the treating session is performed for a duration of 2–3 hours and is repeated 15–20 times during a one month treating course.

10. The method as claimed in claim 1, wherein the isometric physical gymnastics in each of steps (a), (b) and (c) are performed by alternate 5–10 second intervals of tension and relaxation of the muscles.

11. The method as claimed in claim 1, wherein the vibro-influence of step (a) is performed with a frequency of 10–40 Hz and an amplitude of 1–5 mm for 1–5 min, and said treatment session further comprises repeating step (a) 10–15 times.

12. The method as claimed in claim 1, wherein the vibro-influence of step (b) is performed with a frequency of 10–50 Hz and an amplitude of 1–5 mm for 3–15 min, and said treatment session further comprises repeating step (b) up to 3 times.

13. The method as claimed in claim 1, wherein the vibro-influence of step (c) is performed with a frequency of 10–20 Hz and an amplitude of 1–5 mm for 1–5 min, and said treatment session further comprises repeating step (c) up to 5 times.

14. The method as claimed in claim 9, wherein the one month treating course is repeated after 3, 6, and 9 months.

15. The method as claimed in claim 1, further comprising performing one of manual therapy, medical massage with an element of post-isometric relaxation, applied acupuncture, diet therapy, X-ray therapy, psychotherapy and medical correction of lifestyle.

16. The method as claimed in claim 9, wherein the isometric physical gymnastics in each of steps (a), (b) and (c) are performed by alternate 5–10 second intervals of tension and relaxation of the muscles.

17. The method as claimed in claim 9, wherein the vibro-influence of step (a) is performed with a frequency of 10–40 Hz and an amplitude of 1–5 mm for 1–5 min, and said treatment session further comprises repeating step (a) 10–15 times.

18. The method as claimed in claim 10, wherein the vibro-influence of step (a) is performed with a frequency of 10–40 Hz and an amplitude of 1–5 mm for 1–5 min, and said treatment session further comprises repeating step (a) 10–15 times.

19. The method as claimed in claim 9, wherein the vibro-influence of step (b) is performed with a frequency of 50 Hz and an amplitude of 3–5 mm for 3–15 min, and said treatment session further comprises repeating step (b) up to 3 times.

20. The method as claimed in claim 10, wherein the vibro-influence of step (b) is perform with a frequency of 10–50 Hz and an amplitude of—1–5 mm for 3–15 min, and said treatment session further comprises repeating step (b) up to 3 times.

21. The method as claimed in claim 11, wherein the vibro-influence of step (b) is performed with a frequency of 10–50 Hz and an amplitude of 1–5 mm for 3–15 min, and said treatment session further comprises repeating step (b) up to 3 times.

22. The method as claimed in claim 9, wherein the vibro-influence of step (c) is performed with a frequency of 10–20 Hz and an amplitude of 1–5 mm for 1–5 min, and said treatment session further comprises repeating step (c) up to 5 times.

23. The method as claimed in claim 10, wherein the vibro-influence of step (c) is performed with a frequency of 10–20 Hz and an amplitude of 1–5 mm for 1–5 min, and said treatment session further comprises repeating step (c) up to 5 times.

24. The method as claimed in claim 11, wherein the vibro-influence of step (c) is performed with a frequency of 10–20 Hz and an amplitude of 1–5 mm for 1–5 min, and said treatment session further comprises repeating step (c) up to 5 times.

25. The method as claimed in claim 12, wherein the vibro-influence of step (c) is performed with a frequency of 10–20 Hz and an amplitude of 1–5 mm for 1–5 min, and said treatment session further comprises repeating step (c) up to 5 times.

* * * * *